US008274222B2

(12) United States Patent
Ooe et al.

(10) Patent No.: US 8,274,222 B2
(45) Date of Patent: Sep. 25, 2012

(54) PLASMA DISPLAY PANEL HAVING A PROTECTIVE LAYER WHICH INCLUDES AGGREGATED PARTICLES

(75) Inventors: Yoshinao Ooe, Kyoto (JP); Koyo Sakamoto, Osaka (JP); Sadahiro Goto, Osaka (JP); Yoshiyuki Hisatomi, Shiga (JP); Kengo Kigami, Osaka (JP); Kaname Mizokami, Kyoto (JP); Takeshi Kokura, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/321,641

(22) PCT Filed: Mar. 7, 2011

(86) PCT No.: PCT/JP2011/001312

§ 371 (c)(1),
(2), (4) Date: Nov. 21, 2011

(87) PCT Pub. No.: WO2011/111359

PCT Pub. Date: Sep. 15, 2011

(65) Prior Publication Data

US 2012/0068597 A1 Mar. 22, 2012

(30) Foreign Application Priority Data

Mar. 12, 2010 (JP) ..... 2010-055719
Mar. 26, 2010 (JP) ..... 2010-071977

(51) Int. Cl.
*H01J 17/49* (2012.01)

(52) U.S. Cl. ..... 313/587; 313/586

(58) Field of Classification Search ..... 313/586, 313/587; 445/24, 25
See application file for complete search history.

(56) References Cited

U.S. PATENT DOCUMENTS 7,535,178 B2 * 5/2009 Ushizawa et al. ..... 313/586
7,573,200 B2 * 8/2009 Yamamoto et al. ..... 313/587
7,880,387 B2 * 2/2011 Ohtoh et al. ..... 313/587

(Continued)

FOREIGN PATENT DOCUMENTS

JP 8-77933 3/1996

(Continued)

OTHER PUBLICATIONS

International Search Report issued May 24, 2011 in International (PCT) Application No. PCT/JP2011/001312.

*Primary Examiner* — Mariceli Santiago
*Assistant Examiner* — Glenn D Zimmerman
(74) *Attorney, Agent, or Firm* — Wenderoth, Lind & Ponack, L.L.P.

(57) ABSTRACT

A plasma display panel has a front plate and a rear plate disposed so as to face the front plate. The front plate includes display electrodes, a dielectric layer formed to coat the display electrodes, and a protective layer formed to coat the dielectric layer. The protective layer includes a base layer formed on the dielectric layer, and a plurality of particles dispersed in the base layer. The base layer has nanocrystalline particles made of magnesium oxide and having an average particle diameter in the range of at least 10 nm to at most 100 nm. The particles are aggregated particles in which a plurality of metal oxide crystal particles are aggregated. The aggregated particles have an average particle diameter at least twice to at most four times as large as a film thickness of the base layer.

14 Claims, 8 Drawing Sheets

U.S. PATENT DOCUMENTS

| | | | | |
|---|---|---|---|---|
| 7,884,548 | B2 * | 2/2011 | Yoshioka et al. | 313/587 |
| 7,923,931 | B2 * | 4/2011 | Park et al. | 313/586 |
| 2007/0096653 | A1 * | 5/2007 | Jeong et al. | 313/586 |
| 2007/0126361 | A1 * | 6/2007 | Lee | 313/586 |
| 2007/0170865 | A1 * | 7/2007 | Park | 313/587 |
| 2008/0290800 | A1 * | 11/2008 | Saitoh et al. | 313/582 |
| 2009/0256478 | A1 * | 10/2009 | Kawasaki et al. | 313/582 |
| 2009/0305596 | A1 * | 12/2009 | Kuromiya et al. | 445/24 |
| 2010/0039033 | A1 * | 2/2010 | Morita et al. | 313/582 |
| 2010/0102723 | A1 | 4/2010 | Mizokami et al. | |
| 2010/0327741 | A1 * | 12/2010 | Aoto et al. | 313/587 |
| 2011/0048631 | A1 * | 3/2011 | Okumura | 156/272.6 |
| 2011/0171871 | A1 * | 7/2011 | Sekiguchi et al. | 445/25 |
| 2011/0316415 | A1 * | 12/2011 | Mizokami et al. | 313/587 |

FOREIGN PATENT DOCUMENTS

| | | |
|---|---|---|
| JP | 2005-310581 | 11/2005 |
| JP | 2006-59779 | 3/2006 |
| JP | 2006-244784 | 9/2006 |
| JP | 2007-317487 | 12/2007 |
| JP | 2009-129616 | 6/2009 |
| JP | 2010-80183 | 4/2010 |
| WO | WO 2009122737 A1 * | 10/2009 |

* cited by examiner

PLASMA DISPLAY PANEL HAVING A PROTECTIVE LAYER WHICH INCLUDES AGGREGATED PARTICLES

This application is A U.S. National Phase Application of PCT International Application PCT/JP2011/001312.

TECHNICAL FIELD

The technique disclosed herein relates to a plasma display panel used in, for example, a display device.

BACKGROUND ART

A plasma display panel (hereinafter, called a PDP) has a front plate and a rear plate. The front plate includes a glass substrate, display electrodes formed on a main surface of the glass substrate, a dielectric layer covering the display electrodes to function as a capacitor, and a protective layer made of magnesium oxide (MgO) and formed on the dielectric layer.

In order to increase the number of primary electrons released from the protective layer, there has been disclosed a technique of adding impurities to an MgO protective layer (for example, refer to Patent Literature 1). Further, there has been disclosed a technique of forming MgO particles on a base film made of an MgO thin film (for example, refer to Patent Literature 2).

CITATION LIST

Patent Literature

[Patent Literature 1] Unexamined Japanese Patent Publication No. 2005-310581

[Patent Literature 2] Unexamined Japanese Patent Publication No. 2006-59779

SUMMARY OF THE INVENTION

A PDP has a front plate and a rear plate disposed so as to face the front plate. The front plate includes display electrodes, a dielectric layer formed to coat the display electrodes, and a protective layer formed to coat the dielectric layer. The protective layer includes a base film formed on the dielectric layer, and a plurality of particles dispersed in the base film. The base film has nanocrystalline particles made of magnesium oxide and having an average particle diameter in the range of at least 10 nm to at most 100 nm. The particles are aggregated particles in which a plurality of metal oxide crystal particles are aggregated. The aggregated particles have an average particle diameter at least twice to at most four times as large as a film thickness of the base film.

DESCRIPTION OF EMBODIMENTS

First Exemplary Embodiment

1. Structure of PDP 1

Figure 1:
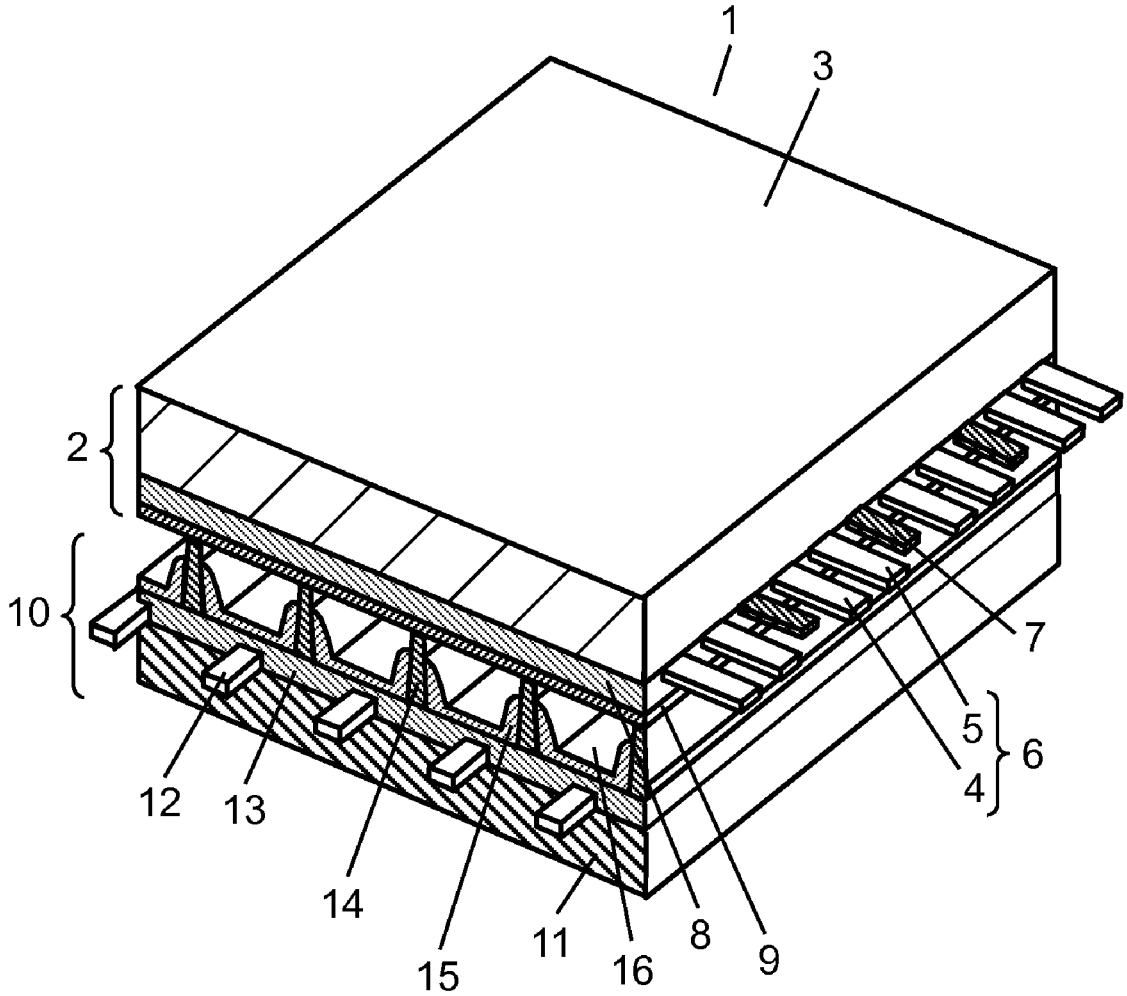
FIG. 1 is a perspective view illustrating a structure of a PDP according to a first exemplary embodiment.

A basic structure of PDP corresponds to that of a general alternating current surface discharge type PDP. As illustrated in FIG. 1, PDP 1 has a structure where front plate 2 including front glass substrate 3 and rear plate 10 including rear glass substrate 11 are disposed facing each other. Outer peripheral portions of front plate 2 and rear plate 10 are air-tightly sealed to each other by a sealing member made of, for example, glass frit. A discharge gas containing, for example, neon (Ne) and xenon (Xe) is enclosed in discharge space 16 inside sealed PDP 1 under a pressure in the range of 53 kPa (400 Torr) to 80 kPa (600 Torr).

A plurality of pairs of band-shape display electrodes 6 each including scan electrode 4 and sustain electrode 5 and a plurality of black stripes 7 are provided on front glass substrate 3 in parallel with one another. Dielectric layer 8 functioning as a capacitor is formed on front glass substrate 3 so as to cover display electrodes 6 and black stripes 7. Further, protective layer 9 made of, for example, magnesium oxide (MgO) is formed on a surface of dielectric layer 8. Note that protective layer 9 will be described in detail later.

Scan electrodes 4 and sustain electrodes 5 are each formed by laminating a bus electrode made of Ag on a transparent electrode made of an electrically conductive metal oxide such as indium tin oxide (ITO), tin oxide ($SnO_2$), or zinc oxide (ZnO).

A plurality of data electrodes 12 made of an electrically conductive material mainly containing silver (Ag) are formed in parallel with each other on rear glass substrate 11 in a direction orthogonal to display electrodes 6. Data electrodes 12 are coated with insulating layer 13. Barrier rib 14 having a predetermined height and dividing discharge space 16 is formed on insulating layer 13 between data electrodes 12. Phosphor layer 15 to emit red light, phosphor layer 15 to emit green light, and phosphor layer 15 to emit blue light under ultraviolet rays are sequentially formed in a groove formed between barrier ribs 14 for each of data electrodes 12. A discharge cell is formed at a position where display electrode 6 and data electrode 12 intersect with each other. The discharge cells respectively having red, green, and blue phosphor layers 15 arranged in the direction along display electrode 6 constitute color display pixels.

In the present exemplary embodiment, the discharge gas enclosed in discharge space 16 includes Xe by at least 10 vol. % to at most 30 vol. %.

2. Production Method of PDP 1

2-1. Formation of Front Plate 2

Scan electrodes 4, sustain electrodes 5, and black stripes 7 are formed on front glass substrate 3 by photolithography.

Scan electrode 4 and sustain electrode 5 respectively have metal bus electrodes 4*b* and 5*b* including silver (Ag) to ensure an electrical conductivity. Scan electrode 4 and sustain electrode 5 respectively include transparent electrodes 4*a* and 5*a*. Metal bus electrode 4*b* is provided on transparent electrode 4*a*, and metal bus electrode 5*b* is provided on transparent electrode 5*a*.

A material such as indium tin oxide (ITO) is used to form transparent electrodes 4*a* and 5*a* to ensure a degree of transparency and an electrical conductivity. First, an ITO thin film is formed on front glass substrate 3 by sputtering, and transparent electrodes 4*a* and 5*a* are then formed in a predetermined pattern by lithography.

A material used to form metal bus electrodes 4*b* and 5*b* is, for example, an electrode paste containing silver (Ag), a glass frit for binding silver, a photosensitive resin, a solvent, and the like. First, the electrode paste is spread on front glass substrate 3 by screen printing, and the solvent in the electrode paste is removed in a baking oven. Next, the electrode paste is exposed to light via a photo mask formed in a predetermined pattern.

Then, the electrode paste is developed so that a metal bus electrode pattern is formed. Lastly, the metal bus electrode pattern is fired at a predetermined temperature in the baking oven. That is, the photosensitive resin in the metal bus electrode pattern is removed. Further, the glass frit in the metal bus electrode pattern is melts. The molten glass frit starts to vitrify again after the firing. As a result of these steps, metal bus electrodes 4*b* and 5*b* are formed.

A material including a black pigment is used to form black stripes 7. Then, dielectric layer 8 is formed. A material used to form dielectric layer 8 is, for example, a dielectric paste containing a dielectric glass frit, a resin, a solvent, and the like. First, the dielectric paste is spread in a predetermined thickness on front glass substrate 3 by die coating or the like so as to cover scan electrodes 4, sustain electrodes 5, and black stripes 7. Next, the solvent in the dielectric paste is removed in a baking oven. Lastly, the dielectric paste is fired at a predetermined temperature in the baking oven. That is, the resin in the dielectric paste is removed. Further, the dielectric glass frit melts. The molten dielectric glass frit starts to vitrify again after the firing. As a result of these steps, dielectric layer 8 is formed. In place of die coating employed to apply the dielectric paste, screen printing, spin coating or the like may be employed. Instead of using the dielectric paste, a film to serve as dielectric layer 8 may also be formed by CVD (Chemical Vapor Deposition) or the like.

The material for dielectric layer 8 contains at least one selected from bismuth oxide ($Bi_2O_3$), calcium oxide (CaO), strontium oxide (SrO), and barium oxide (BaO), and at least one selected from molybdenum oxide ($MoO_3$), tungsten oxide ($WO_3$), cerium oxide ($CeO_2$), and manganese dioxide ($MnO_2$). The binder component is ethyl cellulose, or terpineol containing acrylic resin by 1 wt. % to 20 wt. %, or butyl carbitol acetate. Moreover, if necessary, dioctyl phthalate, dibutyl phthalate, triphenyl phosphate, or tributyl phosphate may be further added to the paste as a plasticizer, and glycerol mono-oleate, sorbitan sesquioleate, HOMOGENOL (product supplied by Kao Corporation), alkylaryl phosphate, or the like may be further added to the paste as a dispersant, to improve a level of printability as the paste.

Next, protective layer 9 is formed on dielectric layer 8. Protective layer 9 will be described in detail later.

As a result of the steps described so far, scan electrodes 4, sustain electrodes 5, black stripes 7, dielectric layer 8, and protective layer 9 are formed on front glass substrate 3, to complete front plate 2.

2-2. Formation of Rear Plate 10

Data electrodes 12 are formed on rear glass substrate 11 by photolithography. A material used to form data electrodes 12 is, for example, a data electrode paste containing silver (Ag) for ensuring electrical conductivity, a glass frit for binding silver, a photosensitive resin, a solvent, and the like. First, the data electrode paste is spread in a predetermined thickness on rear glass substrate 11 by screen printing. Next, the solvent in the data electrode paste is removed in a baking oven. Subsequently, the data electrode paste is exposed to light via a photo mask formed in a predetermined pattern. Then, the data electrode paste is developed so that a data electrode pattern is formed. Lastly, the data electrode pattern is fired at a predetermined temperature in the baking oven. That is, the photosensitive resin in the data electrode pattern is removed. Further, the glass frit in the data electrode pattern melts. The molten glass frit starts to vitrify again after the firing. As a result of these steps, data electrodes 12 are formed. In place of screen printing employed to apply the data electrode paste, sputtering, vapor deposition or the like may be employed.

Then, insulating layer 13 is formed. A material used to form insulating layer 13 is, for example, an insulating paste containing a dielectric glass frit, a resin, a solvent and the like. First, the insulating paste is spread in a predetermined thickness by, for example, screen printing or the like on rear glass substrate 11 having data electrodes 12 formed thereon so as to cover data electrodes 12. Then, the solvent in the insulating paste is removed in the baking oven. Lastly, the insulating paste is fired at a predetermined temperature in the baking oven. That is, the resin in the insulating paste is removed. Further, the dielectric glass frit melts. The molten dielectric glass frit starts to vitrify again after the firing. As a result of these steps, insulating layer 13 is formed. In place of screen printing employed to apply the insulating paste, die coating, spin coating or the like may be employed. Instead of using the insulating paste, a film to serve as insulating layer 13 may be formed by, for example, CVD (Chemical Vapor Deposition).

Next, barrier ribs 14 are formed by photolithography. A material used to form barrier ribs 14 is, for example, a barrier rib paste containing a filler, a glass frit for binding a filler, a photosensitive resin, a solvent, and the like. The barrier rib paste is spread on insulating layer 13 in a predetermined thickness by die coating or the like. Next, the solvent in the barrier rib paste is removed in a baking oven. Next, the barrier rib paste is exposed to light via a photo mask formed in a predetermined pattern. Then, the barrier rib paste is developed so that a barrier rib pattern is formed. Lastly, the barrier rib pattern is fired at a predetermined temperature in the baking oven. That is, the photosensitive resin in the barrier rib pattern is removed. Further, the glass frit in the barrier rib pattern melts. The molten glass frit starts to vitrify again after the firing. As a result of these steps, barrier ribs 14 are formed. The photolithography may be replaced with sandblasting or the like.

Next, phosphor layers 15 are formed. A material used to form phosphor layers 15 is, for example, a phosphor paste containing phosphor particles, a binder, a solvent, and the like. First, the phosphor paste is spread by dispensing or the like in a predetermined thickness on insulating layer 13 between adjacent barrier ribs 14 and side surfaces of barrier ribs 14. Next, the solvent in the phosphor paste is removed in a baking oven. Lastly, the phosphor paste is fired at a predetermined temperature in the baking oven. That is the resin in the phosphor paste is removed. As a result of these steps, phosphor layers 15 are formed. The dispensing may be replaced with screen printing or the like.

As a result of the steps described so far, the production of rear plate 10 provided with the required structural elements on rear glass substrate 11 is completed.

2-3. Assembling of Front Plate 2 and Rear Plate 10

Then, front plate 2 and rear plate 10 are assembled. First, a sealing member (not illustrated in the drawings) is formed around rear plate 10 by dispensing. A material of the sealing member (not illustrated in the drawings) is a sealing paste containing a glass frit, a binder, a solvent, and the like. Next, the solvent in the sealing paste is removed in a baking oven. Next, front plate 2 and rear plate 10 are disposed facing each other so that display electrodes 6 and data electrodes 12 are orthogonal to each other. Then, peripheral portions of front plate 2 and rear plate 10 are sealed by a glass frit. Lastly, the discharge gas containing Ne, Xe, and the like is enclosed in the discharge space, to complete PDP 1.

3. Detail of Protective Layer 9

Figure 2:
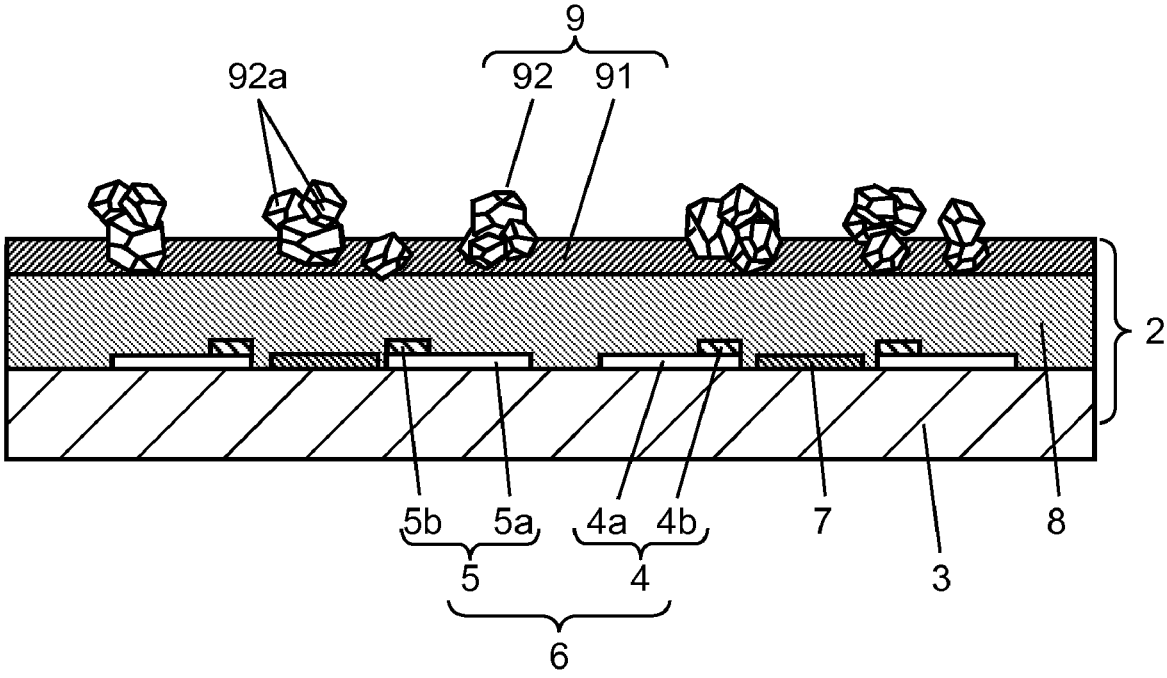
FIG. 2 is a schematic sectional view of a front plate according to the first exemplary embodiment.

As illustrated in FIG. 2, protective layer 9 includes, for example, base film 91 which is a base layer, and aggregated particles 92. For example, base film 91 includes MgO nanocrystalline particles having an average particle diameter in the range of at least 10 nm to at most 100 nm. The nanocrystalline particles are MgO single crystal particles having nano-meter sizes. A plurality of aggregated crystal particles 92*a* made of MgO which is a metal oxide constitute aggregated particles 92. Aggregated particles 92 are preferably evenly dispersed across an entire surface of base film 91. Further, it is configured such that aggregated particles 92 have an average particle diameter at least twice as large as an average film thickness of base film 91. More specifically, aggregated particles 92 are dispersed in base film 91 and protruding toward discharge space 16 from base film 91.

The average particle diameter was measured by observing the nanocrystalline particles and aggregated particles 92 using a SEM (Scanning Electron Microscope).

During an electric discharge in discharge cells, protective layer 9 performs an electron receiving operation. Therefore, protective layer 9 is required to have a high electron emission performance and a high charge retainability.

When the electron emission performance shows a larger numeral value, more electros are released. The electron emission performance is expressed in the form of an primary electron release amount determined by a discharge surface condition, type of gas, and condition of gas. The primary electron release amount can be measured by measuring an electron current amount released from the surface when ion or electron beams is incident thereon, however, it is difficult to perform the measurement in a non-destructive approach. Therefore, the method disclosed in Unexamined Japanese Patent Publication No. 2007-48733 was used. That is, of delay times during the electric discharge, a numeral value as an indicator of a degree of dischargeability, called a statistical delay time, was measured. When an inverse number of the statistical delay time is integrated, a numeral value linearly corresponding to the primary electron release amount is obtained. The discharge delay time is a delay time by which an address discharge delays after the rise of an address discharge pulse. A main likely cause of the discharge delay is that there is some difficulty in releasing the primary electrons which trigger the address discharge from the surface of protective layer 9 into discharge space 16.

An indicator used to evaluate the charge retainability is a voltage (hereinafter, called Vscn lighting voltage) applied to the scan electrodes required for suppressing a phenomenon of the charge release from the protective layer in the PDP. The lower the Vscn lighting voltage is, the higher the charge retainability is. The lower Vscn lighting voltage requires only a small voltage to drive the PDP. Because of this advantage, any parts having a lower dielectric strength and a smaller capacity can be used as a power supply and electric components. Among the products currently available, devices having a dielectric strength of approximately 150 V are conventionally used as a semiconductor switching element such as a MOSFET for sequentially applying scan voltages to a panel. The Vscn lighting voltage is desirably at most 120 V in view of temperature-dependent variability.

In general, the electron emission performance and the charge retainability of protective layer 9 contradict with each other. That is, a high electron emission performance and a high charge retainability which reduces a charge attenuation factor are conflicting properties.

When, for example, deposition conditions of protective layer 9 are changed or protective layer 9 is doped with an impurity such as Al, Si, or Ba for the film formation, the electron emission performance can be improved. This, however, brings an adverse effect, which is increase of the Vscn lighting voltage.

On the other hand, in protective layer 9 according to the present exemplary embodiment, base film 91 includes nanocrystalline particles made of magnesium oxide (MgO) and having an average particle diameter in the range of at least 10 nm to at most 100 nm. Then, an impurity-comparable energy level, which is obtained when, for example, base film 91 is formed by vacuum vapor deposition or the like and doped with a different material, is formed in relatively shallow portions in MgO. Further, aggregated particles 92 having crystal particles 92*a* are formed in base film 91 so as to protrude toward discharge space 16. Such a structure is likely to cause the concentration of electric fields. Therefore, electrons present in a shallow level of base film 91 are pulled upward by the electric fields of aggregated particles 92. Further, the electrons are conveyed on outer surfaces of aggregated particles 92 and then released as secondary electrons. As a result, protective layer 9 according to the present exemplary embodiment has a high electron emission performance.

The nanocrystalline particles constituting base film 91 are microscopically isolated from one another and discontinuous in planar direction unlike a vapor deposition film. Therefore, an insulation property is sustained in the planar direction of base film 91, meaning that an electrical conductivity in the planar direction diminishes. This makes it unlikely that charges stored during the address discharge are scattered around in the planar direction. As a result, protective layer 9 can achieve a high charge retainability. Aggregated particles 92 protruding from base film 91 according to the present exemplary embodiment make the surface of protective layer 9 uneven. Then, the overall surface of protective layer 9 has a larger area relative to a projection area. This makes it difficult for the charges stored in protective layer 9 from scattering around, thereby further improving the charge retainability.

In the case where the average particle diameter of aggregated particles 92 is small, there are more aggregated particles 92 buried under base film 91, deteriorating a second electron emission performance. A relationship between a ratio of the average particle diameter of aggregated particles 92 to the film thickness of base film 91 and the second electron emission performance draws a logistic curve. When the average particle diameter of aggregated particles 92 is at least twice as large as the film thickness of base film 91, the second electron emission performance sharply increases. When the average particle diameter of aggregated particles 92 exceeds about three times of the film thickness of base film 91, the second electron emission performance is saturated. According to the present exemplary embodiment, therefore, the average particle diameter of aggregated particles 92 is at least twice as large as the film thickness of base film 91 to at most four times as large to avoid any product failure caused when, for example, aggregated particles 92 abut barrier ribs 14 of rear plate 10. Therefore, the average particle diameter of aggregated particles 92 is desirably, for example, at least 0.9 μm to at most 4.0 μm as far as the film thickness of base film 91 is about 0.5 μm to 1.0 μm.

As thus described, according to the present exemplary embodiment, protective layer 9 includes base film 91 having nanocrystalline particles and aggregated particles 92 in which crystal particles 92*a* provided in base film 91 are aggregated, so that the electron emission performance and the charge retainability can be both fulfilled.

3-1. Detail of Base Film 91

The nanocrystalline particles are produced by, for example, an instantaneous vapor-phase production method. Describing the instantaneous vapor-phase production method, MgO is, for example, plasma-vaporized and instantaneously cooled down by a coolant gas including a reactive gas so that nano-level fine particles are produced. The present exemplary embodiment uses nanocrystalline particles having an average particle diameter in the range of 10 nm to 100 nm.

The nanocrystalline particles are mixed with terpineol or butyl carbitol and dispersed by a dispersal treatment apparatus so that a nanocrystalline particle fluid dispersion is prepared. In the dispersal treatment, zirconium oxide or aluminum oxide beads are used. The beads preferably have an average particle diameter in the range of 0.02 mm to 0.3 mm. The beads more preferably have an average particle diameter in the range of 0.02 mm to 0.1 mm. The dispersal treatment apparatus is preferably an oscillator mill or an agitator mill designed to oscillate or agitate a mill container filled with the beads and the nanocrystalline particle fluid dispersion.

According to the present exemplary embodiment, the MgO nanocrystalline particles are mixed with butyl carbitol by 5 wt. % to 20 wt. %. Then, the mixture is dispersed so that the nanocrystalline particle fluid dispersion is produced. The mixture is dispersed by a rocking mill which is an agitator mill and under the following conditions; capacity of the mill container is 100 ml, the beads are made of zirconium oxide with the average particle diameter of 0.1 mm, the mill container is filled with the beads by 50 vol. %, number of vibrations is 500 rpm, and treatment time is 60 minutes.

3-2. Detail of Aggregated Particles 92

Figure 3:
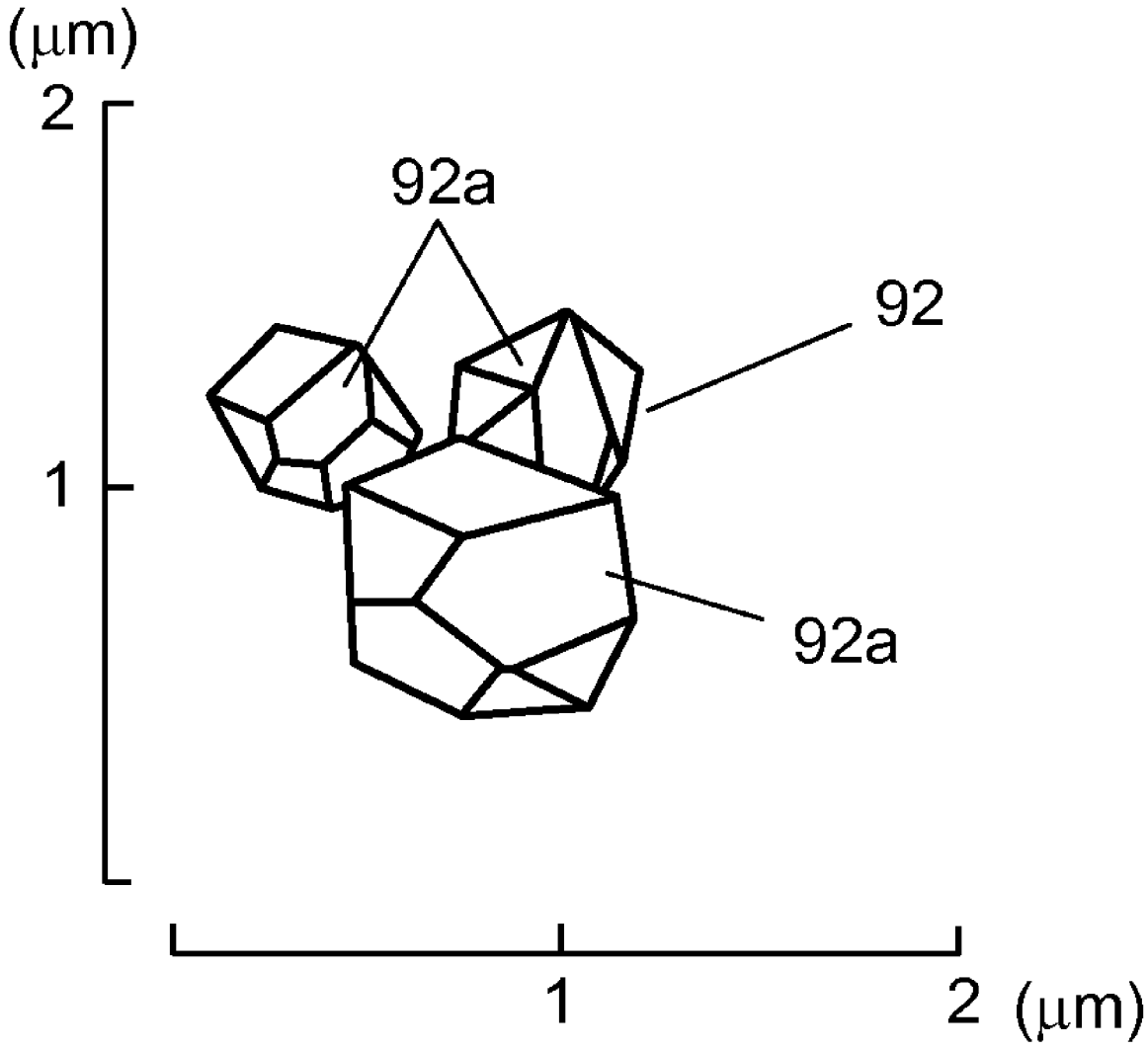
FIG. 3 is an enlarged view of aggregated particles according to the first exemplary embodiment.

As illustrated in FIG. 3, aggregated particle 92 is one in a state where crystal particles 92*a* each having predetermined primary particle diameters are aggregated or necked together. That is, the crystal particles are not firmly bound to one another as solid matters by a large binding strength. Aggregated particle 92 is rather an assembly of primary particles gathered by static electricity or van der Waals' force. More specifically, the crystal particles are bound by such an external force, for example, supersonic wave, that all or a part of aggregated particle 92 is disassembled into primary particles. Aggregated particles 92 each have a particle diameter of approximately 1 μm. Crystal particle 92*a* desirably has a polyhedral shape having at least seven surfaces such as cub-octahedron or dodecahedron.

The primary particle diameters of crystal particles 92*a* can be controlled by adjusting the conditions under which crystal particles 92*a* are produced. When, for example, a magnesium carbonate precursor or a magnesium hydroxide precursor is fired to produce the crystal particles, the particle diameters can be controlled by adjusting a firing temperature and/or firing atmosphere. The firing temperature can be selected from the temperature range 700° C. to 1,500° C. The firing temperatures equal to or higher than 1,000° C. can control the primary particle diameter to about 0.3 μm to 2 μm. When the precursor is fired during the production, aggregated particles 92 in which a plurality of primary particles are aggregated or necked together can be obtained.

3-3. Formation of Protective Layer 9

First, a printing paste is produced as a mixture of 50 wt. % of vehicle mixed with 10 wt. % of acrylic resin, 45 wt. % of nanocrystalline particle fluid dispersion from which the beads are removed, and 5 wt. % of aggregated particles 92. The printing paste is spread on dielectric layer 8 by screen printing and then heated in a baking oven for 20 minutes at the temperature in a range of 100° C. to 120° C. Then, the printing paste is heated in the baking oven for 60 minutes at the temperature in a range of 340° C. to 360° C. In protective layer 9 thus formed, aggregated particles 92 are dispersed in base film 91 including the nanocrystalline particles, and aggregated particles 92 protrude from base film 91.

3-4. Evaluation of Protective Layer 9

Figure 4:
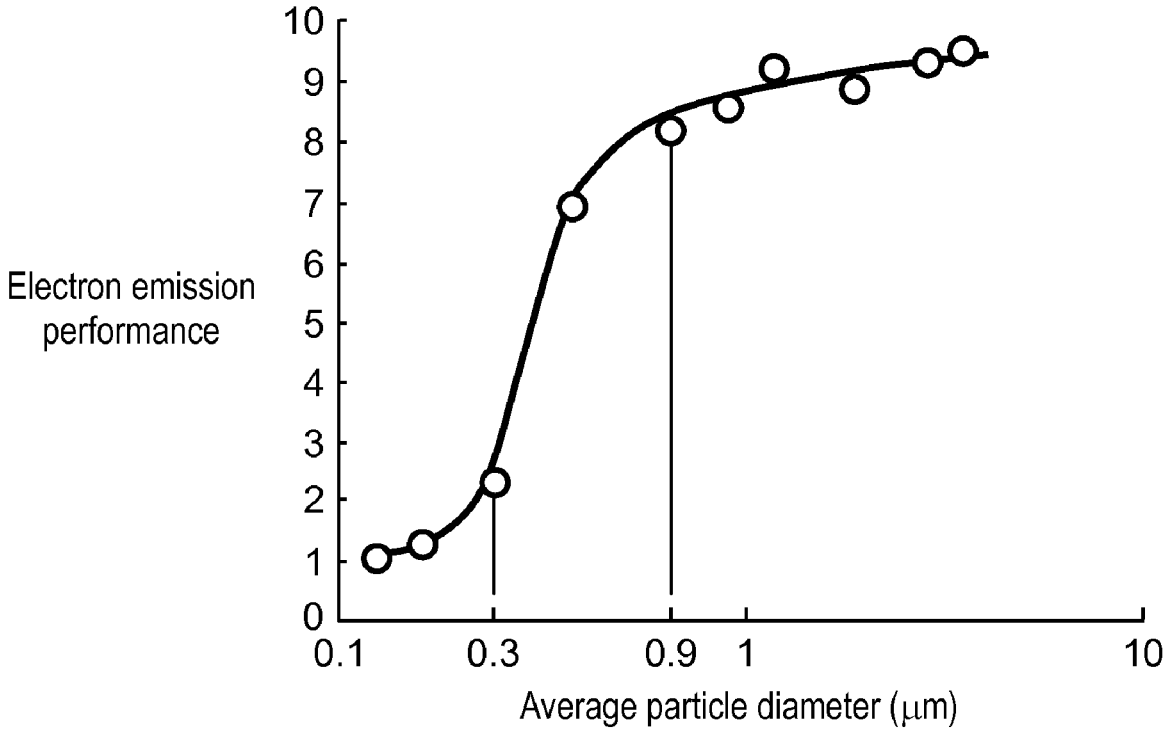
FIG. 4 is a characteristic graph illustrating a relationship between an electron emission performance and an average particle diameter of the aggregated particles.

It is known from FIG. 4 that the electron emission performance is deteriorated when the average particle diameter of aggregated particles 92 is as small as about 0.3 μm, but the electron emission performance is significantly improved as far as the average particle diameter of aggregated particles 92 is equal to or larger than 0.9 μm.

Base film 91 produced as described can reduce an amount of impurity gas adhered thereto. A protective layer formed by vacuum vapor deposition as a comparative example and protective layer 9 including nanocrystalline particles having an average particle diameter in the range of 10 nm to 100 nm formed as a working example were compared and evaluated by thermal desorption spectroscopy.

It was learnt from the evaluation that the working example succeeded in a large reduction of impurity gases such as moisture content, carbon dioxide gas, and CH-based gas as compared to the comparative example. More specifically, in the comparative example, there was a sharp increase in a gas removal amount at 350° C. to 400° C., whereas the working example did not show such an increase. The moisture content, which is an impurity gas, increases a sputtering amount of protective layer 9 as a result of electric discharge. The carbon dioxide gas and CH-based gas, which are also impurity gases, significantly deteriorate phosphor luminescence characteristics of phosphor layers 15. Thus, in the working example, it is possible to accomplish PDP 1 where the adsorption of the impurity gases is largely reduced, high sputtering resistance is achieved, and the deterioration of luminescence performance is suppressed.

The average particle diameter of the nanocrystalline particles from at least 10 nm to at most 100 nm can prevent loss of a visible light transmission factor of protective layer 9, meaning that PDP 1 can sustain high luminescence efficiency. On the other hand, in the case of nanocrystalline particles having an average particle diameter of smaller than 10 nm, the nanocrystalline particles are significantly aggregated to one another. Therefore, they cannot be sufficiently dispersed by a dispersing device such as roll mill, beads mill, supersonic mill, or FILLMIX, meaning that, conversely, the visible light transmission factor is deteriorated. In the case where the average particle diameter of the nanocrystalline particles exceeds 100 nm, light scattering occurs in the nanocrystalline particles, thereby deteriorating the visible light transmission factor.

Base film 91 according to the present exemplary embodiment preferably has a post-firing film thickness equal to or larger than 0.5 μm. This is because the charge retainability improves more than that of conventional evaporated films. Meanwhile, base film 91 preferably has a post-firing film thickness equal to or smaller than 3 μm. This is because the visible light transmission factor of protective layer 9 decreases.

4. Conclusion

Protective layer 9 according to the present exemplary embodiment includes base film 91 which is a base layer formed on dielectric layer 8, and a plurality of particles dispersed in base film 91. Base film 91 has MgO nanocrystalline particles having an average particle diameter in the range of at least 10 nm to at most 100 nm. The particles are aggregated particles 92 in which a plurality of metal oxide crystal particles 92*a* are aggregated. Aggregated particles 92 have an average particle diameter at least twice to at most four times as large as the film thickness of base film 91.

Protective layer 9 with the above configuration achieves a high primary electron emission performance and a high charge retainability. Therefore, the PDP according to the present exemplary embodiment can realize reduced power consumption, improved luminance, higher definition, and the like.

In the present exemplary embodiment, MgO has been illustrated as the nanocrystalline particles of the metal oxide constituting base film 91. However, nanocrystalline particles of a metal oxide other than MgO such as SrO, CaO, or BaO may be used. Further, a mixture of nanocrystalline particles of a plurality of metal oxides may also be used.

Moreover, in the present exemplary embodiment, MgO is illustrated as the crystal particles of the metal oxide constituting aggregated particles 92. However, a similar effect can also be obtained by using, as other single crystal particles, crystal particles made of a metal oxide having a high electron emission performance similarly to MgO such as Sr, Ca, or Ba. Therefore, the crystal particle of the metal oxide is not necessarily limited to MgO.

Second Exemplary Embodiment

1. Structure of PDP 1

PDP 1 according to the present exemplary embodiment is different from PDP 1 according to the first exemplary embodiment in the configurations of dielectric layer 8 and protective layer 9. Therefore, dielectric layer 8 and protective layer 9 will be described in detail below. In the second exemplary embodiment, the same configurations as those of the first exemplary embodiment are denoted by the same reference symbols, and a description thereof will be omitted as appropriate.

2. Detail of Dielectric Layer 8

Figure 5:
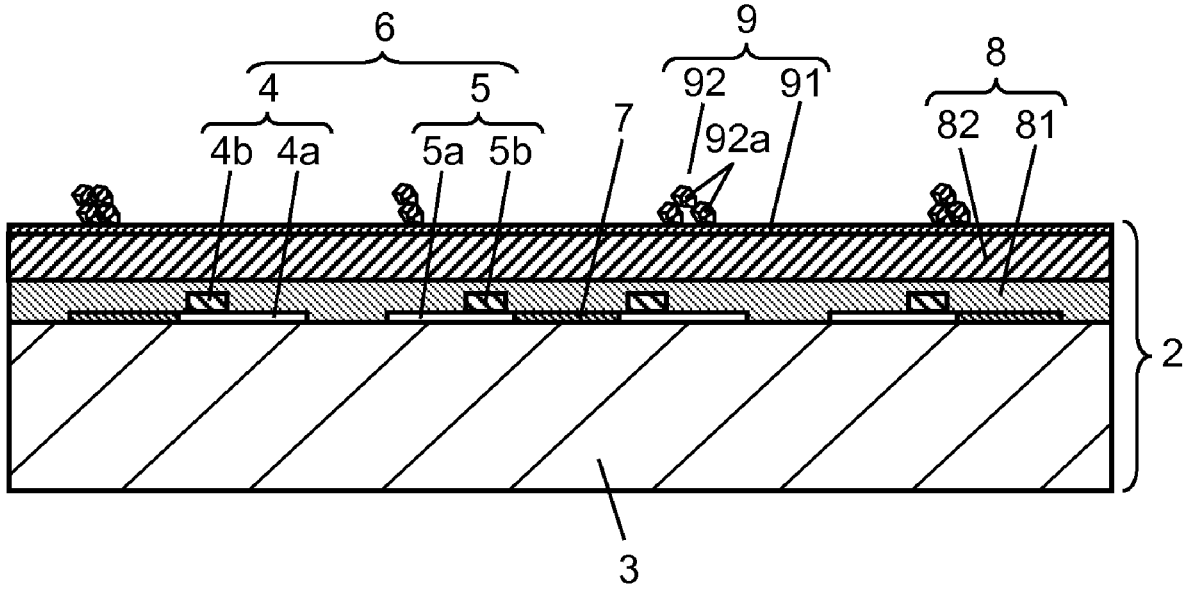
FIG. 5 is a schematic sectional view of a front plate according to a second exemplary embodiment.

As illustrated in FIG. 5, dielectric layer 8 according to the present exemplary embodiment includes at least a two-layered configuration of first dielectric layer 81 formed to coat display electrodes 6 and black stripes 7, and second dielectric layer 82 formed to coat first dielectric layer 81.

2-1. First Dielectric Layer 81

A dielectric material of first dielectric layer 81 includes bismuth trioxide ($Bi_2O_3$) by 20 wt. % to 40 wt. %. Further, the dielectric material of first dielectric layer 81 contains at least one selected from the group of calcium oxide (CaO), strontium oxide (SrO), and barium oxide (BaO) by 0.5 wt. % to 12 wt. %. The dielectric material of first dielectric layer 81 contains at least one selected from the group of molybdenum trioxide ($MoO_3$), tungsten trioxide ($WO_3$), cerium dioxide ($CeO_2$), manganese dioxide ($MnO_2$), copper oxide (CuO), chromium(III) trioxide ($Cr_2O_3$), cobalt(II) trioxide ($Co_2O_3$), vanadium(VII) dioxide ($V_2O_7$), and antimony(II) trioxide ($Sb_2O_3$) by 0.1 wt. % to 7 wt. %.

Further, other than the compounds mentioned so far, there may be included material compositions containing no lead component, such as zinc oxide (ZnO) by 0 wt. % to 40 wt. %, diboron trioxide ($B_2O_3$) by 0 wt. % to 35 wt. %, silicon dioxide ($SiO_2$) by 0 wt. % to 15 wt. %, or dialuminum trioxide ($Al_2O_3$) by 0 wt. % to 10 wt. %. Moreover, the contained amount of any of these materials is not necessarily limited.

The dielectric material having such compositional components is ground by a wet jet mill or a ball mill into particles such that an average particle diameter thereof is from 0.5 μm to 2.5 μm. The ground dielectric material is dielectric material powder. Next, when the dielectric material powders by 55 wt. % to 70 wt. % and a binder component by 30 wt. % to 45 wt. % are kneaded well by three-rolls or the like, to complete a first dielectric layer paste for die coating or printing.

The binder component is ethyl cellulose, or terpineol containing acrylic resin by 1 wt. % to 20 wt. %, or butyl carbitol acetate. Further, if necessary, dioctyl phthalate, dibutyl phthalate, triphenyl phosphate, or tributyl phosphate may be further added to the paste as a plasticizer. Moreover, glycerol monooleate, sorbitan sesquioleate, HOMOGENOL (product supplied by Kao Corporation), alkylaryl phosphate, or the like may be further added to the paste as a dispersant. The addition of the dispersant improves a level of printability.

The first dielectric layer paste is printed on front glass substrate 3 by die coating or screen printing so as to cover display electrodes 6. The first dielectric layer paste thus printed is dried and then fired. A firing temperature is from 575° C. to 590° C. slightly higher than the softening point of the dielectric material.

2-2. Second Dielectric Layer 82

A dielectric material for second dielectric layer 82 contains $Bi_2O_3$ by 11 wt. % to 20 wt. %. Further, the dielectric material for second dielectric layer 82 contains at least one selected from the group of CaO, SrO, and BaO by 1.6 wt. % to 21 wt. %. The dielectric material for second dielectric layer 82 contains at least one selected from $MoO_3$, $WO_3$, cerium oxide ($CeO_2$), CuO, $Cr_2O_3$, $Co_2O_3$, $V_2O_7$, $Sb_2O_3$, and $MnO_2$ by 0.1 wt. % to 7 wt. %.

Further, other than the compounds mentioned so far, there may be included material compositions containing no lead component such as ZnO by 0 wt. % to 40 wt. %, $B_2O_3$ by 0 wt. % to 35 wt. %, $SiO_2$ by 0 wt. % to 15 wt. %, or $Al_2O_3$ by 0 wt. % to 10 wt. %. The contained amount of any of these material compositions is not necessarily limited.

The dielectric material having such compositional components is ground by a wet jet mill or a ball mill into particles such that an average particle diameter thereof is from 0.5 μm to 2.5 μm. The ground dielectric material is dielectric material powder. Next, when the dielectric material powders by 55 wt. % to 70 wt. % and a binder component by 30 wt. % to 45 wt. % are kneaded well by three-rolls, to complete a second dielectric layer paste for die coating or printing.

The binder component of the second dielectric layer paste is similar to the binder component of the first dielectric layer paste.

The second dielectric layer paste is printed on first dielectric layer 81 by die coating or screen printing. The second dielectric layer paste thus printed is dried and then fired. A firing temperature is from 550° C. to 590° C. slightly higher than the softening point of the dielectric material.

2-3. Film Thickness of Dielectric Layer 8

To ensure a high visible light transmission factor, dielectric layer 8 preferably has a film thickness equal to or smaller than 41 μm with first dielectric layer 81 and second dielectric layer 82 altogether. To avoid a reaction with Ag included in metal bus electrodes 4*b* and 5*b*, a larger volume of $Bi_2O_3$ is included in first dielectric layer 81 than $Bi_2O_3$ included in second dielectric layer 82. As a result, the visible light transmission factor of first dielectric layer 81 is lower than that of second dielectric layer 82. Therefore, the film thickness of first dielectric layer 81 is preferably smaller than the film thickness of second dielectric layer 82.

Note that, when $Bi_2O_3$ is included in second dielectric layer 82 by at most 11 wt. %, color staining is less likely. However, air bubbles are more easily generated in second dielectric layer 82. Further, the content of $Bi_2O_3$ by more than 40 wt. % increases the possibility of color staining, deteriorating the visible light transmission factor. Therefore, $Bi_2O_3$ is preferably included by more than 11 wt. % to at most 40 wt. %.

As the film thickness of dielectric layer 8 is smaller, such effects as the luminance improvement and discharge voltage reduction appear more prominently. Therefore, it is desirable to make the film thickness as small as possible to such an extent that a dielectric strength thereof is not deteriorated. Therefore, in the present exemplary embodiment, the film thickness of dielectric layer 8 is at most 41 μm. Further, first dielectric layer 81 has a film thickness in the range of 5 μm to 15 μm, and second dielectric layer 82 has a film thickness in the range of 20 μm to 36 μm.

In PDP 1 according to the present exemplary embodiment, the color staining (turning yellow) of front glass substrate 3 is small regardless of Ag used in display electrodes 6, and lessen air bubbles generated in dielectric layer 8, thereby significantly improving the dielectric strength of dielectric layer 8.

2-4. Discussion of Reasons why Turning Yellow and Air Bubbles are Prevented

When $MoO_3$ or $WO_3$ is added to the dielectric material containing $Bi_2O_3$, such a compound as $Ag_2MoO_4$, $Ag_2Mo_2O_7$, $Ag_2Mo_4O_{13}$, $Ag_2WO_4$, $Ag_2W_2O_7$, or $Ag_2W_4O_{13}$ is easily generated at temperatures equal to or lower than 580° C. According to the present exemplary embodiment, the firing temperature of dielectric layer 8 is 550° C. to 590° C. Therefore, silver ions ($Ag^+$) diffused in dielectric layer 8 during firing react with $MoO_3$ or $WO_3$ in dielectric layer 8, thereby generating and stabilizing stable compounds. Thus, $Ag^+$ is not reduced but is stabilized. The stabilization of $Ag^+$ lessens oxygen generated by the colloidization of Ag, thereby lessening air bubbles generated in dielectric layer 8.

To further improve these effects, at least one selected from $MoO_3$, $WO_3$, $CeO_2$, CuO, $Cr_2O_3$, $Co_2O_3$, $V_2O_7$, $Sb_2O_3$, and $MnO_2$ is preferably included in the dielectric material containing $Bi_2O_3$ by at least 0.1 wt. %, and more preferably included by at least 0.1 wt. % to at most 7 wt. %. Especially, in the case where any of these compounds is included by less than 0.1 wt. %, turning yellow is not very effectively controlled, and color staining is unfavorably generated in the glass when included by more than 7 wt. %.

That is, in dielectric layer 8 according to the present exemplary embodiment, first dielectric layer 81 in contact with metal bus electrodes 4*b* and 5*b* containing Ag can prevent turning yellow and the generation of air bubbles. Further, second dielectric layer 82 provided on first dielectric layer 81 helps to accomplish a high light transmission factor. As a result, it is possible to realize PDP 1 with extremely little generation of air bubbles and turning yellow, and with a high light transmission factor as a whole of dielectric layer 8.

3. Detail of Protective Layer 9

The protective layer mainly has four functions. The first one is to protect the dielectric layer from the impact of ions through the electric discharge. The second one is to release primary electrons to cause address discharge. The third one is to retain charges for causing the electric discharge. The fourth one is to release secondary electrons during sustain discharge. Because the dielectric layer is protected from the ion-induced impact, a discharge voltage is prevented from increasing. As more primary electrons are released, an address discharge error, which is a factor responsible for flickering images, is less likely to occur. Improvement of the charge retainability reduces the voltage to be applied, and a sustain discharge voltage is lowered because more secondary electrons are released. An attempt for increasing the primary electrons to be released is to add, for example, silicon (Si) or aluminum (Al) to MgO of the protective layer.

The improvement of the primary electron emission performance by mixing the impurity with MgO increases an attenuation factor by which the electric charges stored in the protective layer decrease with time. This requires a countermeasure, for example, increasing the applied voltage to compensate for the attenuated electric charges. It is demanded that the protective layer meet two contradictory requirements: high primary electron emission performance; and small charge attenuation factor, in other words, high charge retainability.

3-1. Structure of Protective Layer 9

As illustrated in FIG. 5, protective layer 9 according to the present exemplary embodiment includes base film 91 which is a base layer, and aggregated particles 92. Base film 91 is an MgO film including germanium (Ge) and cerium (Ce). Aggregated particle 92 has a structure where a plurality of MgO crystal particles 92*a* are aggregated. According to the present exemplary embodiment, a plurality of aggregated particles 92 are dispersed in an entire surface of base film 91. Aggregated particles 92 are preferably evenly dispersed in the entire surface of base film 91 because an in-plane variability of the discharge voltage is thereby lessened.

3-2. Formation of Base Film 91

Base film 91 is formed by, for example, EB (Electron Beam) vapor deposition. A material of base film 91 is a pellet mainly containing single crystal MgO. First, the pellet placed in a deposition chamber of an EB vapor deposition apparatus is irradiated with electron beams. The pellet is vaporized under the energy from the electron beams. The vaporized MgO adheres onto dielectric layer 8 placed in the deposition chamber. The thickness of the MgO film is adjusted to stay within a predefined range by changing the intensity of the electron beams or the pressure of the deposition chamber. The film thickness of base film 91 is, for example, about 500 nm to 1,000 nm.

In the production of samples described later, a pellet mainly containing MgO and further including an impurity by a predetermined concentration was used.

3-3. Formation of Aggregated Particles 92

For example, the film is formed by, for example, screen printing. The screen printing uses a metal oxide paste in which aggregated particles 92 are kneaded with an organic resin component and a diluent. Specifically, the metal oxide paste is spread on the entire surface of base film 91 so that a metal oxide paste film is formed. The film thickness of the metal oxide paste film is, for example, about 5 μm to 20 μm. Note that, the metal oxide paste film is formed on base film 91 by spraying, spin coating, die coating, or slit coating other than screen printing.

Then, the metal oxide paste film is dried. The metal oxide paste film is heated at a predetermined temperature in, for example, a baking oven. The temperature range is, for example, about 100° C. to 150° C. The heating treatment removes the solvent component from the metal oxide paste film.

Then, the dried metal oxide paste film is fired. The metal oxide paste film is heated at a predetermined temperature in, for example, a baking oven. The temperature range is, for example, about 400° C. to 500° C. A firing atmosphere is not particularly limited. Atmospheric air, oxygen, or nitrogen, for example, is used. The heating treatment removes the resin component from the metal oxide paste film.

4. Test Result

Next, a description will be given of a test result conducted for the purpose of confirming properties of protective layer 9 according to the present exemplary embodiment. A plurality of PDPs respectively having protective layer 9 with a different configuration were produced as samples.

Sample 1 is a PDP having a protective layer including an MgO film alone.

Sample 2 is a PDP having a protective layer including MgO doped with an impurity such as Al or Si.

Sample 3 is a PDP having a protective layer including a MgO base film and primary particles of MgO crystal particles dispersed in the base film.

Sample 4 is a PDP having a protective layer including a base film in which MgO is doped with Ce by 200 ppm to 500 ppm as an impurity and aggregated particles 92 evenly dispersed in the entire surface of the base film.

Sample 5 is a PDP having protective layer 9 including base film 91 in which MgO is doped with Ge and Ce by 200 ppm to 500 ppm and aggregated particles 92 evenly dispersed in the entire surface of base film 91.

In Samples 3, 4, and 5, crystal particles 92*a* are single crystal particles made of magnesium oxide (MgO).

Figure 6:
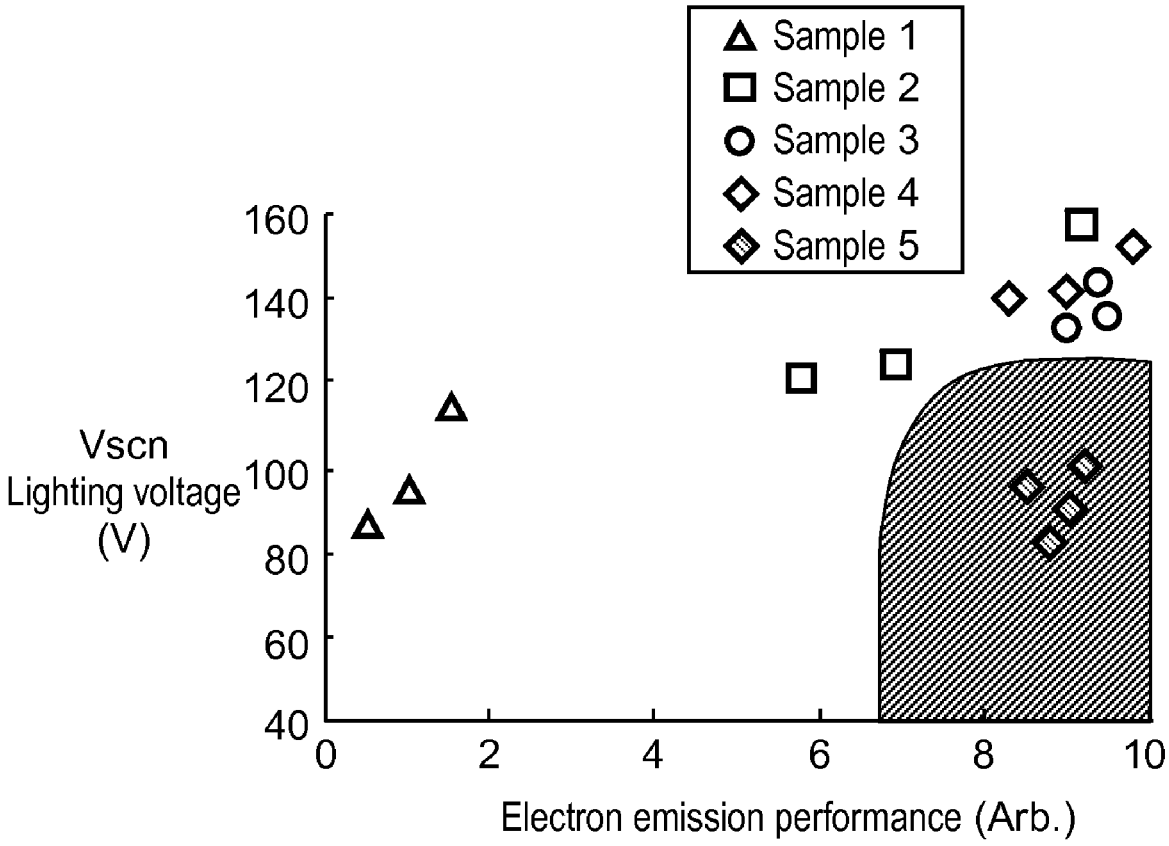
FIG. 6 is a graph illustrating a relationship between the electron emission performance and a Vscn lighting voltage.
Figure 7:
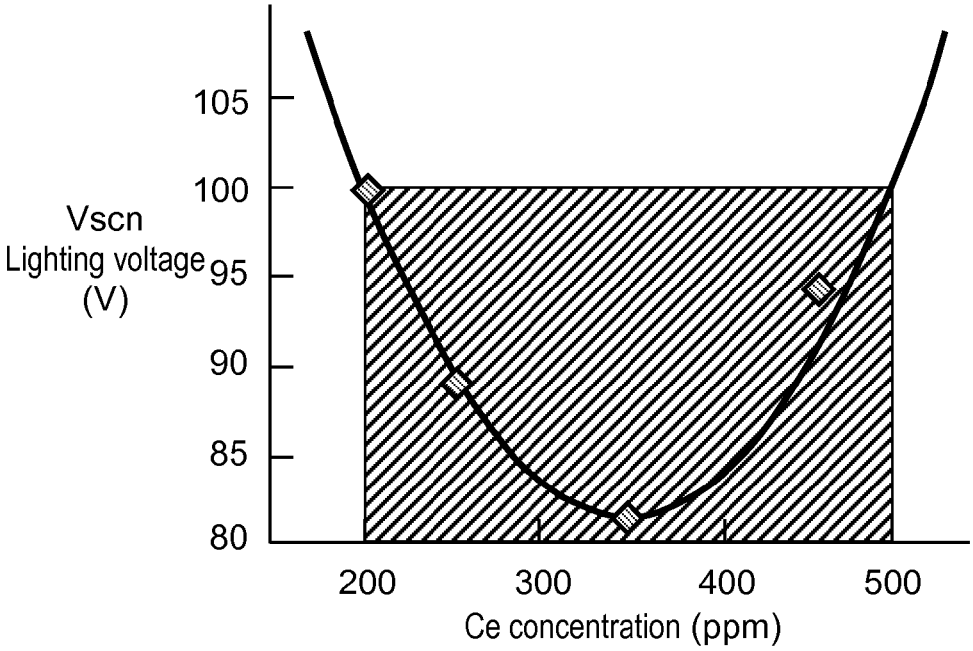
FIG. 7 is a graph illustrating a relationship between a cerium concentration and the Vscn lighting voltage.

FIG. 6 shows the electron emission performance and the charge retainability of the protective layer. The electron emission performance is a standard value expressed based on an average value of Sample 1. It is found that Sample 5 succeeded in controlling the Vscn lighting voltage, which is an evaluation result of the charge retainability, to at most 120 V, and can further obtain such a favorable property of at least 8 for the electron emission performance. Therefore, even PDP 1 with the number of scanning lines tending to increase and its cell size tending to decrease due to higher definition can satisfy both the electron emission performance and the charge retainability. Further, because of the Vscn lighting voltage equal to or lower than 100 V, devices having a smaller dielectric strength can be used so that power consumption can be reduced.

Protective layer 9 according to the present exemplary embodiment includes Ce in MgO so that a band structure having a narrower energy width is formed in a relatively shallow energy zone in the band structure of MgO. As a result, the electric charges are stored on the surface of protective layer 9, which increases the attenuation factor by which the electric charges when used as a memory function reduce with time. However, it is considered that, by making Ge into MgO along with Ce, a charge retaining band structure is formed in the relatively shallow energy zone in the band structure of MgO, thereby improving the charge retainability.

Sample 1 can control the Vscn lighting voltage to about 100 V. However, Sample 1 has a very poor electron emission performance as compared to the other samples.

Sample 2 has a relatively high electron emission performance as compared to Sample 1 but has a poor charge retainability, meaning that the Vscn lighting voltage is higher than that of Sample 5. The reason for the high electron emission performance is considered to be that Al or Si doped in MgO creates an impurity level inside MgO, releasing the electrons from the impurity level. The impurity level, however, facilitates the transfer of electrons toward the film surface. Therefore, it is considered that the stored charges are scattered by way of the impurity level, resulting in the poor charge retainability.

Sample 3 has a higher electron emission performance than Samples 1 and 2 but has a poor charge retainability, meaning that the Vscn lighting voltage is higher than that of Sample 5.

The reason for the poor charge retainability is considered to be that electric field concentration is generated as the retained charges are accumulated in crystal particles 92*a*, and a phenomenon occurs in which the charges are released toward crystal particles 92*a* where the charges are not yet retained in the discharge cell. It is therefore considered preferable to deconcentrate the charges on base film 91 to avoid the electric field concentration.

That is, when MgO is doped with Al, Si, or Ce, dispersion of charges on base film 91 becomes extremely large. However, the charges can be dispersed on base film 91 to a suitable extent when base film 91 in which MgO is doped with Ce is further doped with Ge as in Sample 5.

Note that, the concentration of Ge in base film 91 below 100 ppm is insufficient in view of improving the charge retainability. The concentration of Ge in base film 91 exceeding 5,000 ppm makes the vapor deposition instable, making it difficult to control the evaporation of the pellet.

The concentration of Ce in base film 91 below 200 ppm is insufficient in view of improving the charge retainability. The concentration of Ce in base film 91 exceeding 500 ppm makes the vapor deposition instable, making it difficult to control the evaporation of the pellet.

Note that, as far as the Ce concentration in base film 91 is from at least 200 ppm to at most 500 ppm as illustrated in FIG.

7, the Vscn lighting voltage is controlled to be at most 100 V. The Ge concentration in base film 91 at the time is 2,000 ppm.

5. Action of Aggregated Particles 92

It was confirmed from the test conducted by the present inventors that the main effects of MgO aggregated particle 92 are to prevent a discharge delay in the address discharge, and improve any temperature dependency of the discharge delay. Therefore, in the present exemplary embodiment, the outstanding feature of aggregated particles 92 which is a higher primary electron emission performance than base film 91 is used. Specifically, aggregated particles 92 is provided as a primary electron supplier necessary for the rise of a discharge pulse.

Figure 8:
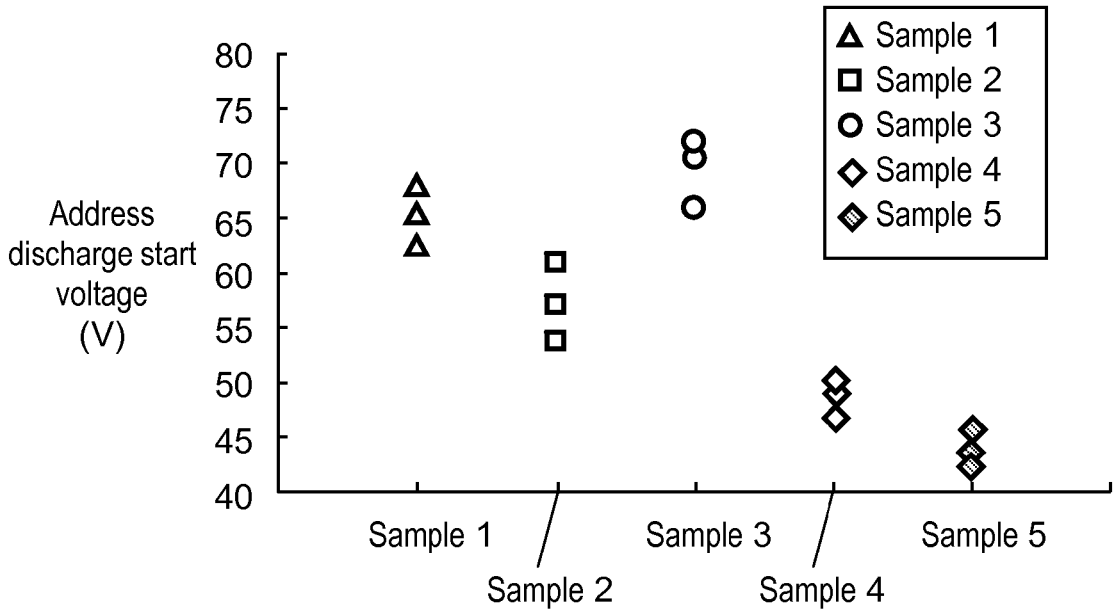
FIG. 8 is a graph illustrating an address discharge start voltage.

As illustrated in FIG. 8, Sample 5 according to the present exemplary embodiment can regulate an address discharge start voltage to at most 50 V. The decrease in address discharge start voltage is considered to be that an amount of electrons released from protective layer 9 is increased by aggregated particles 92. Samples 1 to 5 illustrated in FIG. 8 correspond to Samples 1 to 5 illustrated in FIG. 6.

According to the present exemplary embodiment, when aggregated particles 92 are made to adhere onto base film 91, aggregated particles 92 adhere thereto so as to be distributed across the entire surface thereof by a coating rate in the range of at least 10% to at most 20%. The coating rate is the percentage represented by a ratio of an area a to which aggregated particles 92 adhere to an area b of one discharge cell in one discharge cell region, and obtained by a formula: coating rate (%)=a/b×100. To actually measure the coating rate, image in a region corresponding to one discharge cell divided by barrier ribs 14 is captured. Then, the image is trimmed in the size of an x×y cell, and the trimmed image is binarized into black and white data. Then, an area a of a black area of aggregated particles 92 is obtained based on the binarized data, and the coating rate is calculated from the formula of a/b×100.

Note that, as illustrated in FIG. 4, the electron emission performance is deteriorated when the average particle diameter is as small as about 0.3 μm, whereas the electron emission performance is improved when the average particle diameter is substantially at least 0.9 μm.

To increase the number of released electrons in the discharge cell, the number of crystal particles on protective layer 9 per unit area is desirably larger. It was learnt from the test conducted by the present inventors that the top portions of barrier ribs 14 may be broken in the case where crystal particles 92*a* are present on or near the top portions of barrier ribs 14 in close contact with protective layer 9, in which case the material of broken barrier ribs 14 might drop on the phosphors, possibly failing to light on or off any relevant cell. Such an unfavorable event as the breakage of the barrier rib is unlikely to occur as far as crystal particles 92*a* are not present on or near the top portions of the barrier ribs, meaning that the probability for occurrence of the breakage of barrier ribs 14 is higher as more crystal particles adhere.

Figure 9:
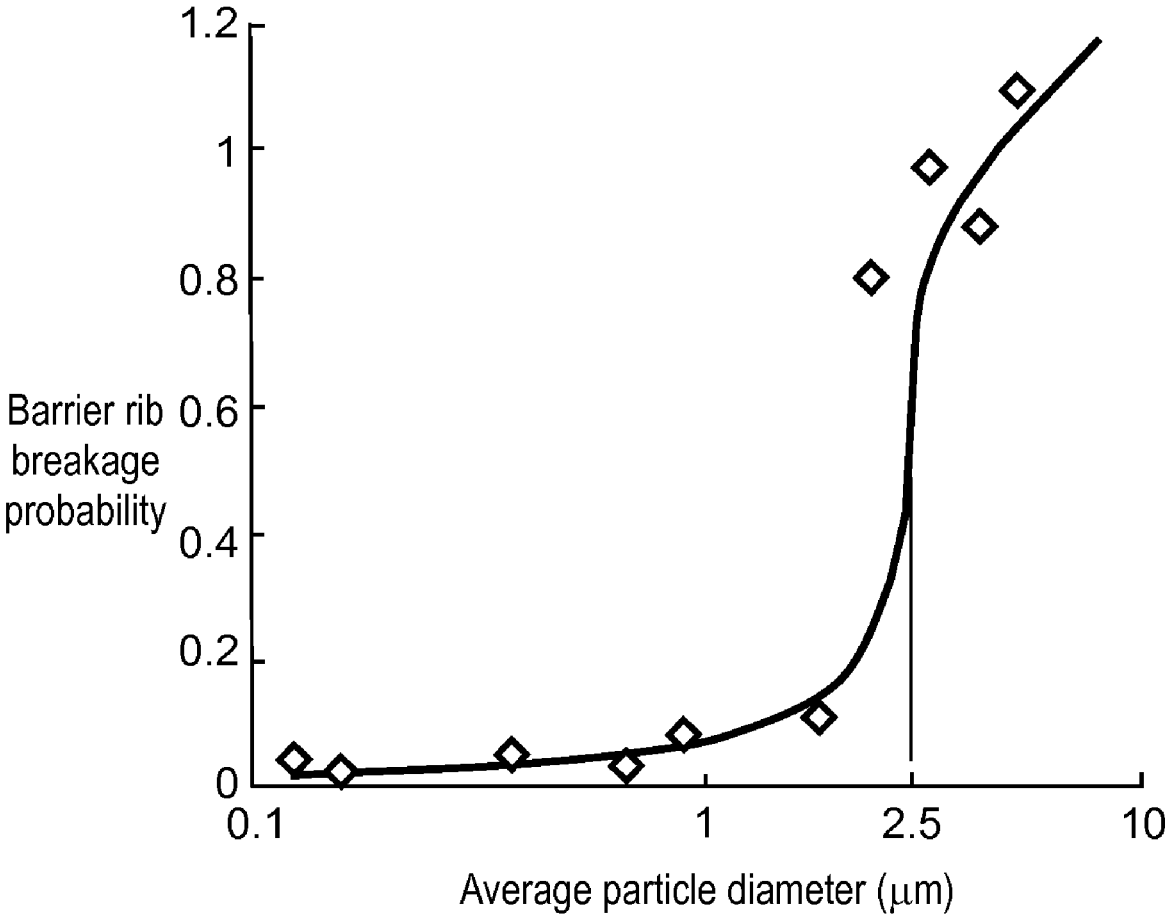
FIG. 9 is a graph illustrating a relationship between a barrier rib breakage probability and the average particle diameter of the aggregated particles.

As seen from FIG. 9, the probability of the barrier rib breakage soars when the particle diameter becomes as large as about 2.5 μm, while the probability of the barrier rib breakage can be suppressed to be relatively small as far as the particle diameter is smaller than 2.5 μm.

Based on the above result, the average particle diameter of aggregated particles 92 is desirably at least 0.9 μm to at most 2.5 μm. For mass production of PDP, it is necessary to take into account production variability of crystal particles 92 and production variability of the protective layer.

It has been found that, taking into account the factors of the production variability, the effect described so far could be reliably obtained as far as aggregated particles 92 having particle diameter in the range of 0.9 μm to 2 μm were used.

6. Conclusion

Protective layer 9 according to the present exemplary embodiment includes base film 91 which is a base layer formed on dielectric layer 8, and aggregated particles 92 in which a plurality of metal oxide crystal particles 92*a* dispersed across the entire surface of base film 91 are aggregated. Base film 91 includes MgO, Ce, and Ge. The Ce concentration in base film 91 is at least 200 ppm to at most 500 ppm, and the Ge concentration in base film 91 is at least 100 ppm to at most 5,000 ppm.

Protective layer 9 with the above configuration achieves a high primary electron emission performance and a high charge retainability. Therefore, the PDP according to the present exemplary embodiment can realize reduced power consumption, improved luminance, higher definition and the like.

In the present exemplary embodiment, MgO particles have been described as the metal oxide crystal particles constituting the aggregated particles. However, a similar effect can be obtained when other metal oxide crystal particles are used, for example, metal oxide crystal particles containing SrO, CaO, $Ba_2O_3$, and $Al_2O_3$ having a high electron emission performance similarly to MgO. The kind of particle is not necessarily limited to MgO.

INDUSTRIAL APPLICABILITY

As described above, the technique disclosed in the exemplary embodiments of the present invention is useful in realization of a PDP wherein a display performance with a higher image quality and reduction of power consumption are both accomplished.

REFERENCE MARKS IN THE DRAWINGS

1 PDP
2 front plate
3 front glass substrate
4 scan electrode
4*a*, 5*a* transparent electrode
4*b*, 5*b* metal bus electrode
5 sustain electrode
6 display electrode
7 black stripe
8 dielectric layer
9 protective layer
10 rear plate
11 rear glass substrate
12 data electrode
13 insulating layer
14 barrier rib
15 phosphor layer
16 discharge space
81 first dielectric layer
82 second dielectric layer
91 base film
92 aggregated particle
92*a* crystal particle

The invention claimed is:

1. A plasma display panel comprising:
a front plate; and a rear plate disposed so as to face the front plate, wherein the front plate includes display electrodes, a dielectric layer formed to coat the display electrodes, and a protective layer formed to coat the dielectric layer, wherein the protective layer includes a base film formed on the dielectric layer, and a plurality of aggregated particles dispersed in the base film, wherein each of the aggregated particles includes a plurality of nanocrystalline particles aggregated together by static electricity or van der Waals' force, wherein each of the nanocrystalline particles is made of magnesium oxide and has an average particle diameter in the range of at least 10 nm to at most 100 nm, wherein the aggregated particles have an average particle diameter at least twice to at most four times as large as a film thickness of the base film, and wherein the plurality of aggregated particles protrude from the base film toward a discharge space formed between the front plate and the rear plate.

2. The plasma display panel according to claim 1, wherein the aggregated particles have an average particle diameter in the range of at least 0.9 μm to at most 4.0 μm.

3. The plasma display panel according to claim 1, wherein the base film has a film thickness in the range of at least 0.5 μm to at most 3.0 μm.

4. The plasma display panel according to claim 2, wherein the base film has a film thickness in the range of at least 0.5 μm to at most 3.0 μm.

5. The plasma display panel of claim 4, wherein the aggregated particles are discrete from each other.

6. The plasma display panel of claim 4, wherein the aggregated particles are discrete from each other and evenly dispersed in the entire surface of the base film.

7. The plasma display panel of claim 6, wherein the aggregated particles have a particle diameter of about 1 μm.

8. The plasma display panel of claim 7, wherein each of the nanocrystalline particles has a polyhedral shape having at least seven surfaces.

9. The plasma display panel of claim 4, wherein the aggregated particles have a particle diameter of about 1 μm.

10. The plasma display panel of claim 4, wherein each of the nanocrystalline particles has a polyhedral shape having at least seven surfaces.

11. The plasma display panel of claim 1, wherein the aggregated particles are discrete from each other.

12. The plasma display panel of claim 1, wherein the aggregated particles are discrete from each other and evenly dispersed in the entire surface of the base film.

13. The plasma display panel of claim 1, wherein the aggregated particles have a particle diameter of about 1 μm.

14. The plasma display panel of claim 1, wherein each of the nanocrystalline particles has a polyhedral shape having at least seven surfaces.

* * * * *